United States Patent [19]

Tilly

[11] Patent Number: 4,921,169

[45] Date of Patent: May 1, 1990

[54] METHOD FOR SUPPLYING AN ELECTRICALLY CONDUCTIVE FLOATING MEDIUM AND A DEVICE FOR PERFORMING THE METHOD

[76] Inventor: Leif Tilly, Blankavägen 15, S-433 02 Partille, Sweden

[21] Appl. No.: 249,565

[22] PCT Filed: Mar. 23, 1987

[86] PCT No.: PCT/SE87/00149

§ 371 Date: Sep. 16, 1988

§ 102(e) Date: Sep. 16, 1988

[87] PCT Pub. No.: WO87/05832

PCT Pub. Date: Oct. 8, 1987

[30] Foreign Application Priority Data

Mar. 24, 1986 [SE] Sweden ..... 8601352

[51] Int. Cl.[5] ..... B05B 5/02; B05B 5/08

[52] U.S. Cl. ..... 239/3; 239/112; 239/690

[58] Field of Search ..... 118/302, 629; 427/27; 239/112, 113, 3, 690, 691, 708

[56] References Cited

U.S. PATENT DOCUMENTS 3,906,122 9/1975 Krause et al. ..... 239/3 X 3,937,400 2/1976 Krause ..... 239/3 X 4,771,729 9/1988 Planert et al. ..... 118/697

*Primary Examiner*—Evan Lawrence

[57] ABSTRACT

A method for supplying an electrically conductive, floating medium, e.g. paint, from a storage system (11) via a feed conduit to a consumption station (12) in which is incorporated an electrostatically chargeable distribution device (29), e.g. a paint spraying gun, for treatment, e.g. painting of treatment units, whereby the medium is supplied to an intermediate storage forming part of the feed conduit between the consumption station and the storage system, and which feed conduit is adapted to be interrupted electrically and physically between the storage system and the intermediate storage by an interruption unit. The purpose is to prevent the electrostatic charge in the spraying nozzle from being transferred to the storage system of the painting plant. This has been solved in that the medium is pumped from the storage system via a first feed conduit to a first closed valve part forming part of the interruption unit, the second valve part of which, which is connected to a second feed conduit, at interconnection thereof establishes a closed medium connection between the feed conduits, that the medium during the interconnection period of the valve parts is pumped to the intermediate storage, whereby the electrostatic charging is interrupted, and that after disconnection of the valve parts the medium is subjected to pressure in the intermediate storage and during electrostatic charging is supplied to the distribution device.

16 Claims, 2 Drawing Sheets

METHOD FOR SUPPLYING AN ELECTRICALLY CONDUCTIVE FLOATING MEDIUM AND A DEVICE FOR PERFORMING THE METHOD

FIELD OF THE INVENTION

The present invention refers to a method for supplying an electrically conductive, floating medium, e.g. paint, from a storage system via a feed conduit to a consumption station in which is incorporated an electrostatically chargeable distribution device, e.g. a paint spraying gun, for treatment, e.g. painting of treatment units, whereby the medium is supplied to an intermediate storage forming part of the feed conduit between the consumption station and the storage system, and which feed conduit is adapted to be interrupted electrically and physically between the storage system and the intermediate storage by means of an interruption unit. The invention furthermore incorporates a device for performing the method.

BACKGROUND OF THE INVENTION

The use of water based paints in combination with electrostatic charging has brought about that the safety aspects have been focused, as short circuits between the high-voltage electrostatic charging in the paint gun and the grounded paint conduit system may occur.

Different devices are earlier known for preventing such potential differences to arise. All these known methods operate according to the so called "rain-drop principle", which means that the storage container, in which the paint is stored, is separated from the electrostatically charged paint gun, and supplies the paint drop by drop via such a big air-gap that no spark-over can occur. These devices however have the drawback of having a very limited capacity and do not allow a continuous spray painting, particularly if it concerns bigger painting objects, such as e.g. car bodies.

Another problem at conventional painting paints is the difficulty to change paint during the short time required for moving away the treated object and placing a new painting object within the action radius of the paint gun. As the painting ever more is carried out with aid of robots it is preferred that the paint change shall be effected without the need of changing spraying equipment.

SUMMARY OF THE INVENTION

The purpose of the invention is to provide a method and a device wherein the electrostatic charging in the spraying nozzle is not transferred to the storage system of the painting plant. Another purpose is to become independent of the comparatively long time required for the dielectric transfer of the paint, and to be able to make a paint change in a simple and very swift manner. The demand from the car producer can be, e.g. that before painting of each car body it shall be possible to make a paint change. These tasks have been solved in that the medium is pumped from the storage system via a first feed conduit to a first closed valve part forming part of said interruption unit, the second valve part of which, which is connected to a second feed conduit, at interconnection thereof establishes a closed medium connection between the feed conduits, that the medium during the interconnection period of the valve parts is pumped to the intermediate storage, whereby the electrostatic charging is interrupted, and that after disconnection of the valve parts the medium is subjected to pressure in the intermediate storage and during electrostatic charging is supplied to the distribution device.

The device according to the invention is characterized therein that the interruption unit incorporates a first valve part, forming part of the feed conduit of the storage system and a second valve part forming part of the feed conduit of the distribution device, that the valve parts are connectable in a fluid-tight manner and electrically, physically releasable from each other by means of an actuator, which creates an air-gap between the spaced apart valve parts, that upstream of the interruption unit in the conduit is provided an intermediate storage, the volume of which at least corresponds to the treatment of a treatment object, and that a control device is provided, which during the interconnecting phase of the valve parts interrupts the electrostatic charging.

BRIEF DESCRIPTION OF THE DRAWINGS

The invention will hereinafter be further described with referenced to the accompanying drawings, which show an embodiment of the invention.

DESCRIPTION OF THE PREFERRED EMBODIMENTS

Figure 1:
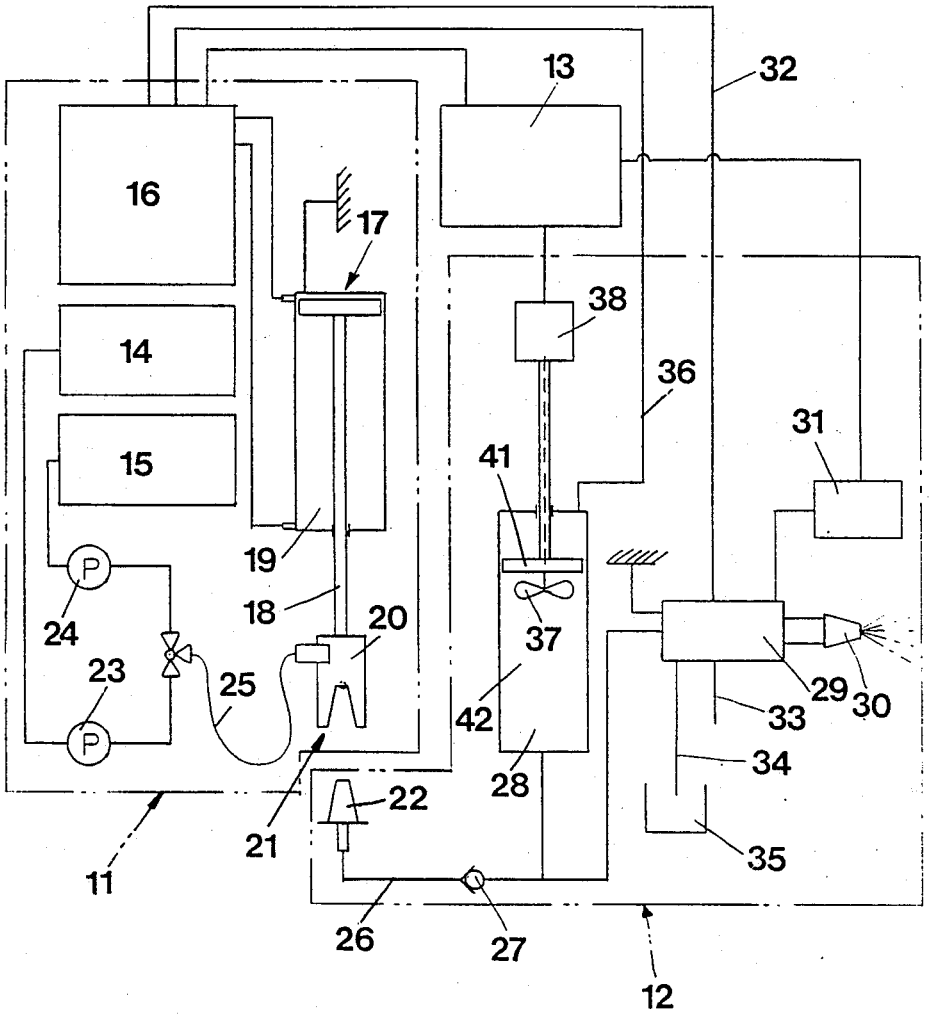
FIG. 1 shows highly schematized a painting plant wherein the method and the device according to the invention have been applied.

In FIG. 1, the numeral 11 refers to a storage system and 12 is a consumption station, which both form part of a preferably computerized painting plant, where the computer is designated 13.

The storage system 11 incorporates a storage tank 14, for e.g. a water based paint, a rinsing medium container 15, a pressure air source 16 and an actuator 17 connected thereto and designed as a pneumatically driven piston 18 and cylinder 19. The piston rod 18 at its free end carries one part 20 of a two part valve 21, the other part 22 of which forms part of the consumption station 12. The valve 21, which is designed as an interruption unit, has one of its parts 20 connected to a conduit 25, which is branched off to the storage tank 14 and also the rinsing medium tank 15 via one pump 23,24 each, whereas the other valve part 22 is connected to a conduit 26 belonging to the consumption station 12.

Upstream of the valve part 22 of the interruption unit 21 is arranged a non-return valve 27 in the conduit 26, a dosing pump 28 and a distribution device 29, e.g. a spraying device having a spraying nozzle 30. The dosing pump 28, which consists of piston pump with adjustable displacement is so designed, that the piston pump cylinder can be used as an intermediate storage, which has such a big volume that the stored quantity lasts for e.g. one treatment - painting - of a treatment object. The consumption station 12 furthermore incorporates a high voltage source 31, which can create an electrostatic power field within the spraying device 29. To this is furthermore connected a pressure air conduit 32 from the pressure air source 16 and on one hand an air outlet 33 and on the other hand a draining conduit 34, which open in a container 35 for used rinsing fluid.

The dosing pump 28 is driven by pressure air via the conduit 36 form the pressure air source 16. The dosing pump 28 furthermore has a means for brining about turbulence, which means e.g. can be a propeller 37 driven by a motor 38.

Figures 2, 3:
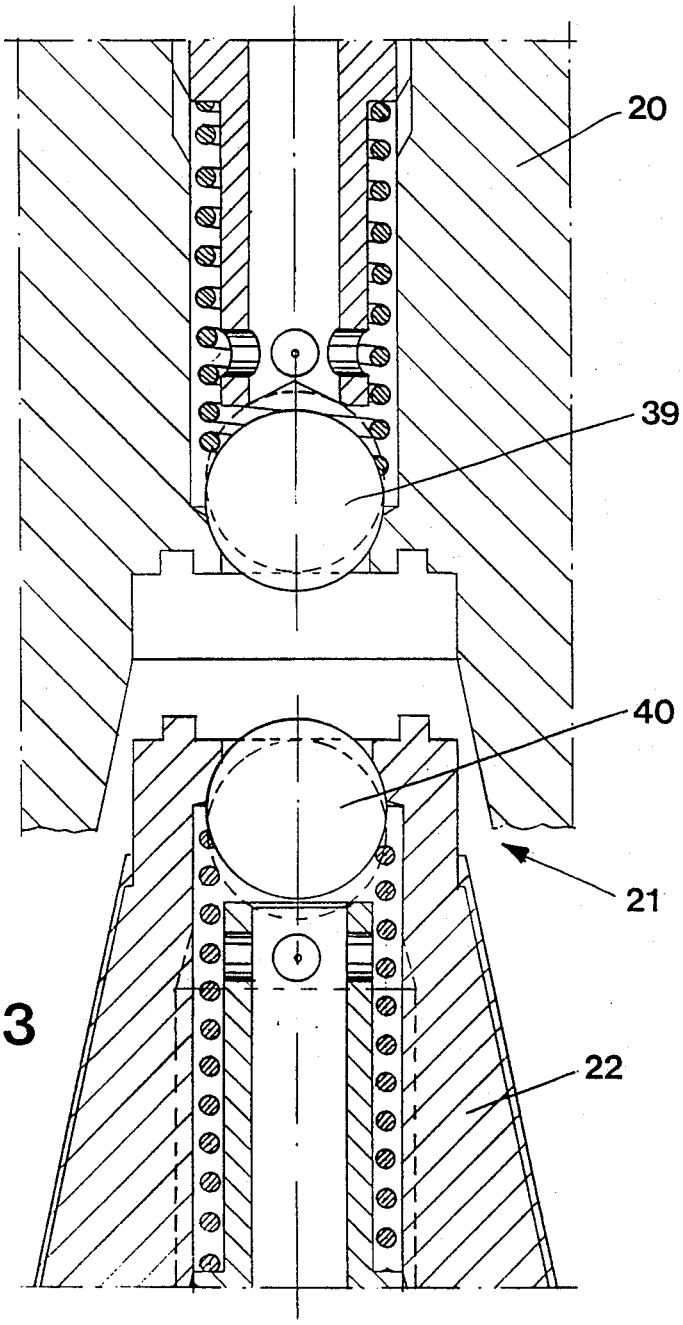
FIGS. 2 and 3 show in bigger scale sections through valve parts of an interruption unit forming part of the painting plant.

The first operation moment in the painting plant is that the computer 13 of a corresponding control mechanism gives a signal to the pressure air source 16 to actuate the actuator 17, thus that the piston 18 is displaced in the cylinder 19 and the two valve parts 20,22 of the interruption unit 21 are displaced towards each other thus that an interconnection of the conduits 25 and 26 is effected. As seen from FIGS. 2 and 3 the two valve parts are both provided with a spring-loaded valve body 39,40, which in the interconnected position of the two valve parts 20,22 are pressed against each other and thereby open the through passage for the medium. When the interconnection is made the pump 23 is started, and pumps the chosen paint color via the conduits 25 and 26 to the dosing pump 28, in which the piston rod, by provision of the computer 13, has taken up such a position that, in consideration to the painting object, a proper quantity is supplied to the pump cylinder acting as intermediate storage. The pump 23 is stopped when said intermediate storage has been filled and the interruption unit 21 is pulled apart, thus that electric transfer is impossible also by air spark-over. The high voltage aggregate 31 is started by the computer thus that an electrostatic field is created in the spraying device 29, whereupon, via an inpulse from the computer 13, pressure air from the pressure air source 16 is fed to the negative side of the dosing pump 28, thus that paint is fed up to the spraying device 29 and out through the spraying nozzle 30. As the quantity of paint in the dosing pump 28 is adjusted thus that it is just enough for painting the treatment object in question, the pump room 42 will be substantially emptied. The high voltage aggregate 31 is thereupon closed off and the two valve parts 20 and 22 of the interruption unit thereupon again be interconnected, whereupon the next operation cycle can be started.

If a paint change is desired prior to the next transfer of new paint, the computer 13 starts the pump 24, which from the rinsing fluid container 14 pumps rinsing fluid through the entire storage system and the consumption system, whereby the turbulence creating means 37 in the dosing pump 28 can give the rinsing fluid such a movement that all paint therein is dissolved and rinsed out. After the rinsing medium has passed the spraying device 29 it is discharged at one hand through the spraying nozzle 30 and on the other hand via the rinsing medium conduit 34 to the container 35. The conduit system may possibly also be connected to the pressure air source 16, thus that a subsequent blow-by with pressure air can be made, thus that all paint and rinsing medium residues are rinsed out of the conduits.

The invention is not limited to the embodiment shown but a plurality of variations are possible within the scope of the claims. Thus it is possible that as many storage tanks are included in the system as the number of paint colors, thus that an immediate paint change can be effected. The dosing pump furthermore can be of another type and the intermediate storage can be a separate container.

I claim:

1. A method of handling electrically conductive liquid, said method comprising the steps of:

(a) adjusting the volume of a chamber of a pump so that said chamber can contain no more than a desired quantity of electrically conductive liquid;

(b) thereafter accumulating said desired quantity of electrically conductive liquid in said chamber by transferring said electrically conductive liquid form a storage location, through a first valve part and a second valve part, and into said chamber of said pump;

(c) physically disconnecting said first valve part and said second valve part from each other so that static electricity cannot flow from said second valve part to said first valve part; and (d) while said first valve part and said second valve part are physically disconnected from each other, pumping said electrically conductive liquid form said chamber to a spraying device and electrostatically charging said electrically conductive liquid.

2. The method of claim 1, wherein said electrically conductive liquid is paint.

3. The method of claim 1, wherein said step of adjusting the volume of said chamber includes adjusting the stroke of a piston located within said pump.

4. The method of claim 3, wherein said pump is driven by pressurized air.

5. The method of claim 1, further comprising the steps of:

flushing said valve parts and said chamber of said pump with a rinsing medium after said conductive liquid has been pumped from said chamber; and thereafter transferring a second desired quantity of electrically conductive liquid through said valve parts and into said chamber of said pump.

6. The method of claim 5, wherein said step of flushing said valve parts and said chamber includes generating turbulence within said chamber.

7. A system for handling electrically conductive liquid, said system comprising:

a pump with a chamber, and adjusting means for adjusting the volume of said chamber of said pump so that said chamber can contain no more than a desired quantity of electrically conductive liquid;

a first valve part, a second valve part, and means for accumulating said desired quantity of electrically conductive liquid in said chamber by transferring said electrically conductive liquid from a storage location, through said first valve part and said second valve part, and into said chamber of said pump;

means for physically disconnecting said first valve part and said second valve part from each other so that static electricity cannot flow from said second valve part to said first valve part; and pumping and charging means for pumping said electrically conductive liquid form said chamber to a spraying device and electrostatically charging said electrically conductive liquid, said pumping and charging means being operative while said first valve part and said second valve part are physically disconnected from each other.

8. The system of claim 7, wherein said pump is a dosing pump with a piston located within said chamber, said adjusting means including means for adjusting the stroke of said piston.

9. The system of claim 8, wherein said dosing pump includes turbulence generating means for generating turbulence in said chamber.

10. The system of claim 9, wherein said turbulence generating means includes a propeller located within said chamber for stirring said liquid.

11. A system for handling electrically conductive liquid, said system comprising:

(a) charging means for electrostatically charging electrically conductive liquid;

(b) an intermediate storage pump for pumping a desired quantity of said electrically conductive liquid to said charging means; and (c) valve means for transferring said electrically conductive liquid from a storage location to said intermediate storage pump, said valve means including:

(1) an outlet conduit connected to said intermediate storage pump;

(2) a second valve part connected to said outlet conduit;

(3) a first valve part which is connectable to said first valve part;

(4) an inlet conduit connected to said first valve part for transferring said electrically conductive liquid from said storage location to said first valve part; and (5) a piston-operated device for linearly displacing said second valve part with respect to said first valve part to physically disconnect said second valve part from said first valve part so that static electricity cannot flow from said first valve part to said second valve part.

12. The system of claim 11, wherein said inlet conduit is the only conduit connected to said second valve part of transferring liquid to said second valve part, said inlet conduit being adapted to transfer a rinsing medium to said second valve path.

13. The system of claim 11, wherein said charging means includes a paint spraying gun.

14. The system of claim 11, further comprising a single source of pressurized air for operating both said piston-operated device and said intermediate storage pump.

15. A system for handling electrically conductive liquid, said system comprising:

a dosing pump with a chamber, a piston located within said chamber, and turbulence generating means for generating turbulence within said chamber;

a first valve part, a second valve part, and means for accumulating electrically conductive liquid in said chamber by transferring said electrically conductive liquid from a storage location, through said first valve part and said second valve part, and into said chamber of said pump;

means for physically disconnecting said first valve part and said second valve part from each other so that static electricity cannot flow from said second valve part to said first valve part; and pumping and charging means for pumping said electrically conductive liquid from said chamber to a charging device and electrostatically charging said electrically conductive liquid, said pumping and charging means being operative while said first valve part and said second valve part are physically disconnected from each other.

16. The system of claim 15, wherein said turbulence generating means includes a propeller located within said chamber for stirring said liquid.

* * * * *